US009354552B2

(12) United States Patent
Takeuchi

(10) Patent No.: US 9,354,552 B2
(45) Date of Patent: May 31, 2016

(54) CARTRIDGE WITH FLEXIBLE CONTAINER FOR ACCOMMODATING DEVELOPER

(71) Applicant: CANON KABUSHIKI KAISHA, Tokyo (JP)

(72) Inventor: Toshiaki Takeuchi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/309,050

(22) Filed: Jun. 19, 2014

(65) Prior Publication Data

US 2014/0376955 A1 Dec. 25, 2014

(30) Foreign Application Priority Data

Jun. 24, 2013 (JP) ..... 2013-131849

(51) Int. Cl.
*G03G 15/08* (2006.01)
*G03G 21/18* (2006.01)

(52) U.S. Cl.
CPC ..... *G03G 15/0881* (2013.01); *G03G 15/0874* (2013.01); *G03G 21/1803* (2013.01); *G03G 15/0882* (2013.01)

(58) Field of Classification Search
CPC ..... G03G 15/0881; G03G 15/0874; G03G 15/0882; G03G 21/1803
USPC ..... 399/106, 111, 113, 114, 102, 103, 105
See application file for complete search history.

(56) References Cited

U.S. PATENT DOCUMENTS

| | | | | |
|---|---|---|---|---|
| 5,294,960 | A * | 3/1994 | Nomura | G03G 15/0898 156/94 |
| 2003/0031479 | A1* | 2/2003 | Ito | 399/27 |
| 2003/0223776 | A1* | 12/2003 | Kato et al. | 399/120 |
| 2005/0180784 | A1* | 8/2005 | Yoshida | 399/284 |
| 2014/0086620 | A1 | 3/2014 | Takeuchi et al. | |
| 2014/0086621 | A1 | 3/2014 | Makiguchi et al. | |
| 2014/0093272 | A1 | 4/2014 | Matsumaru et al. | |
| 2014/0126928 | A1 | 5/2014 | Batori et al. | |
| 2014/0212166 | A1 | 7/2014 | Takeuchi et al. | |
| 2014/0212181 | A1 | 7/2014 | Nakamura et al. | |
| 2014/0348535 | A1 | 11/2014 | Murakami et al. | |
| 2014/0356020 | A1 | 12/2014 | Murakami et al. | |
| 2015/0003865 | A1 | 1/2015 | Batori et al. | |

FOREIGN PATENT DOCUMENTS

| | | | | |
|---|---|---|---|---|
| JP | H04-66980 | | 3/1992 | |
| JP | 08305163 | A * | 11/1996 | G03G 15/08 |

* cited by examiner

*Primary Examiner* — Billy Lactaoen
(74) *Attorney, Agent, or Firm* — Fitzpatrick, Cella, Harper & Scinto

(57) ABSTRACT

A cartridge detachably mountable to a main assembly of an image forming apparatus includes: a frame; a flexible container, provided with an opening at a side thereof and provided inside the frame, for accommodating a developer; and a sealing member for sealing the opening. The sealing member is removable when being used. The flexible container includes a bottom portion forming a bottom thereof. The bottom portion is provided vertically above a lower end of the opening in a state in which the cartridge is mounted in the main assembly.

16 Claims, 13 Drawing Sheets

(a)

(b)

(a)

(b)

CARTRIDGE WITH FLEXIBLE CONTAINER FOR ACCOMMODATING DEVELOPER

FIELD OF THE INVENTION AND RELATED ART

The present invention relates to a cartridge for accommodating a developer and an image forming apparatus to which the process cartridge is detachably mountable.

A developing device refers to a developing device, including a developer carrying member, for visualizing an electrostatic image with a developer.

Example of the cartridge may include a developing cartridge and the process cartridge. The process cartridge is prepared by integrally assembling an image bearing member and an actable means actable on the image bearing member into a cartridge (unit), which is detachably mountable to an apparatus main assembly of the image forming apparatus.

The image forming apparatus forms an image no a recording material (medium) by using an electrophotographic image forming type (process). Examples of the image forming apparatus may include an electrophotographic copying machine, an electrophotographic printer (LED printer, laser beam printer or the like), a facsimile machine, a word processor and so on.

Japanese Laid-Open Patent Application (JP-A) Hei 4-66980 discloses a constitution in which a flexible container is provided inside a frame of a cartridge and in which a developer is accommodated in the flexible container.

However, in the constitution of JP-A Hei 4-66980, in order to discharge the developer accommodated in the flexible container, there was a need to provide a leaf spring in the flexible container (FIG. 15).

SUMMARY OF THE INVENTION

The present invention has been accomplished in view of the above circumstances. A principal object of the present invention is to provide a cartridge capable of efficiently discharging a developer accommodated in a flexible container without providing a leaf spring in the flexible container.

According to an aspect of the present invention, there is provided a cartridge detachably mountable to a main assembly of an image forming apparatus, comprising: a frame; a flexible container, provided with an opening at a side thereof and provided inside the frame, for accommodating a developer; and a sealing member for sealing the opening, wherein the sealing member is to be removed when being used, wherein the flexible container includes a bottom portion forming a bottom thereof, and wherein the bottom portion is provided vertically above a lower end of the opening in a state in which the cartridge is mounted in the main assembly.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments for carrying out the present invention will be specifically described with reference to the drawings. Dimensions, materials, shapes and relative positions of constituent elements described in the following embodiment should be appropriately be changed depending on structures and various conditions of devices (apparatuses) to which the present invention is applied. Accordingly, the scope of the present invention is not intended to be limited to the following embodiments unless otherwise specified.

Embodiment 1

Figure 1:
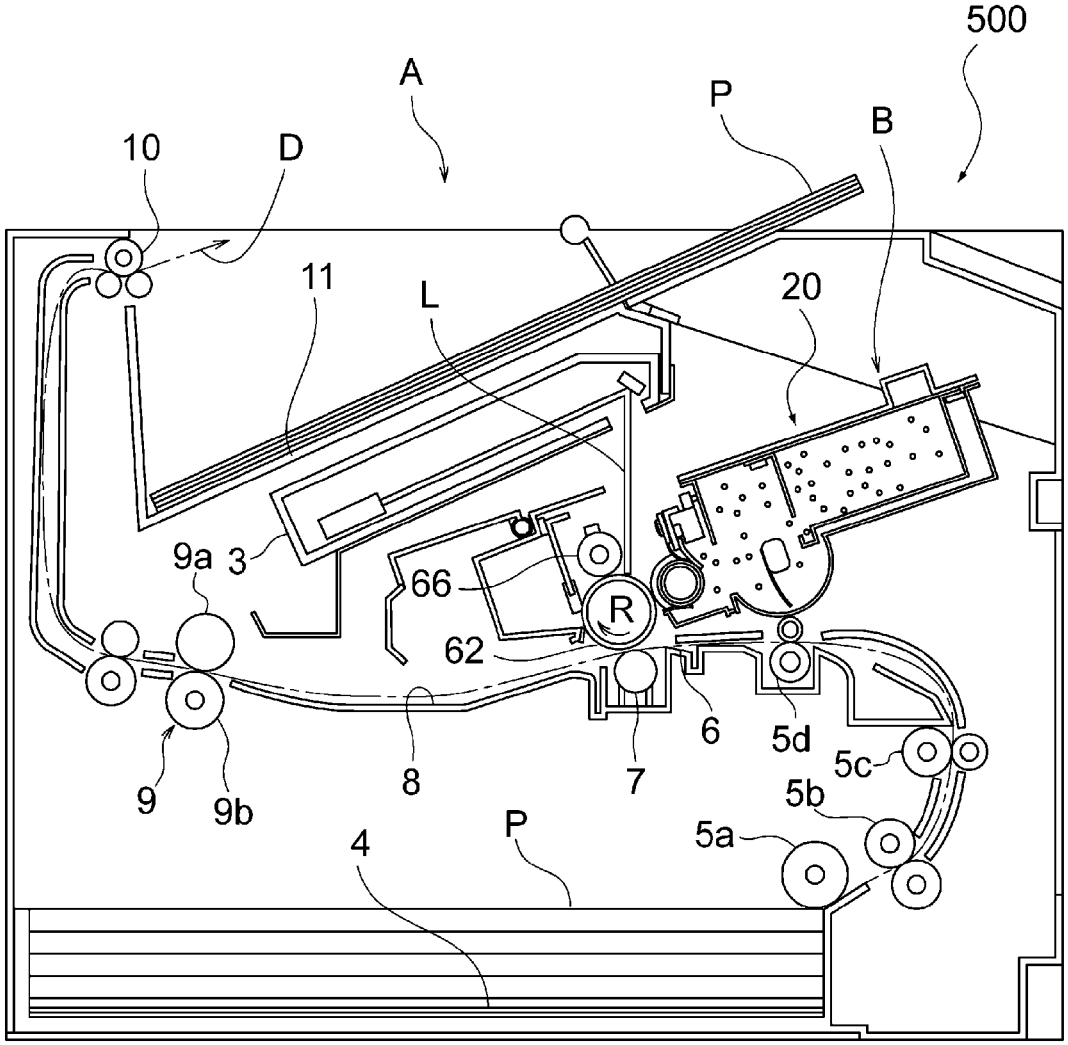
FIG. 1 is a sectional view of an image forming apparatus in Embodiment 1.

FIG. 1 is a sectional view of an image forming apparatus 500 in this embodiment. As shown in FIG. 1, the image forming apparatus 500 includes an apparatus main assembly A. Inside the apparatus main assembly A, photosensitive drum 62 (image bearing member) is provided. At a periphery of the photosensitive drum 62, a charging roller 66, an exposure device 3, a developing unit 20 and a transfer roller 7 are provided. The photosensitive drum 62, the charging roller 66 and the developing unit 20 are assembled into a cartridge B (process cartridge or developing cartridge). The cartridge B is detachably mountable to the apparatus main assembly A.

Further, inside the apparatus main assembly A, a tray 4 in which a sheet P as a recording material (medium) is accommodated is provided. The sheet P mounted on the tray 4 is fed in a feeding direction of the sheet P. The sheet P passes through a pick-up roller 5*a*, a feeding roller pair 5*b*, a conveyance roller pair 5*c*, a registration roller pair 5*d*, a transfer guide 6, a nip between the photosensitive drum 62 and the transfer roller 7, a feeding guide 8 and a fixing device 9 and then is discharged onto an external tray 11 through a discharging roller pair 10. The fixing device 9 includes a heating roller 9*a* and a pressing roller 9*b*.

The surface of the photosensitive drum 62 is electrically charged uniformly by the charging roller 66, and then an electrostatic image is formed by laser light L emitted from the exposure device 3. Thereafter, the electrostatic image is developed with a developer into a developer image by the developing unit 20. On the other hand, the sheet P placed in the tray 4 is fed from the pick-up roller 5*a* and then is conveyed to a transfer nip between the photosensitive drum 62 and the transfer roller 7. Here, onto the sheet P, the developer image is transferred from the photosensitive drum 62. Thereafter, on the sheet P, the developer image is fixed by the fixing device 9.

Figure 2:
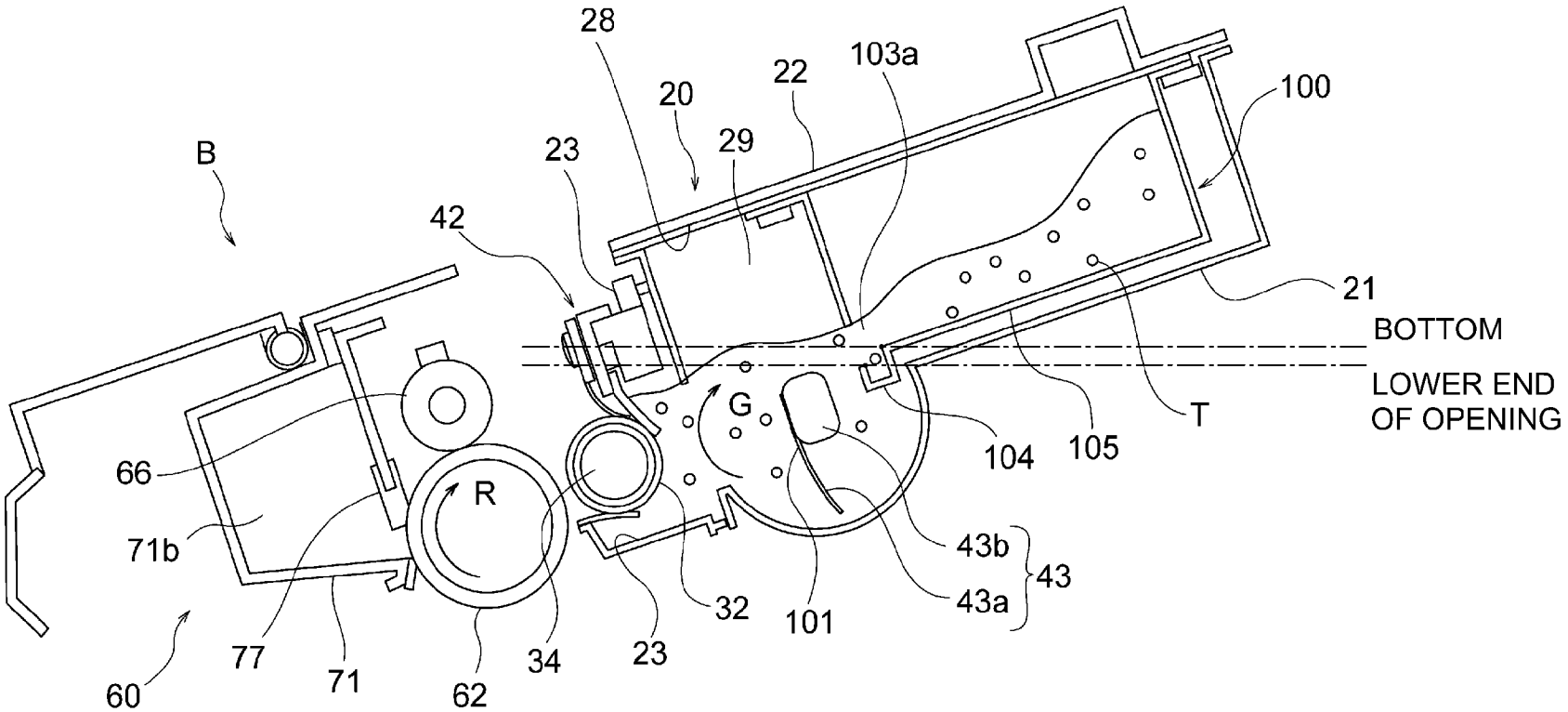
FIG. 2 is a sectional view of a cartridge.

FIG. 2 is a sectional view of the cartridge B. As shown in FIG. 2, the cartridge B includes the developing unit 20 and a cleaning unit 60. The developing unit 20 includes an accommodating container 21 and a cover 22 which are used as a frame. Inside the accommodating container 21 and the cover 22, a supplying chamber 28 and a developing chamber 23 are defined. Inside the supplying chamber 28, a developer bag 100 is pulled up. Inside the developer bag 100, a developer T is accommodated.

Inside the supplying chamber 28, an actable member 43 is rotatably mounted. When the actable member 43 is rotated, the developer T discharged from the developer bag 100 and fed in the supplying chamber 28 is fed to a developing chamber 23 while being stirred. The actable member 43 includes a sheet member 43*a*. This sheet member 43*a* is formed in a sheet shape of a flexible material such as PPS, PC or PET.

At an opening of the developing chamber 23, a developing roller 32 (developer carrying member) is rotatably mounted. The developing roller 32 includes a magnet roller 34 therein and carries the developer T at a surface thereof by a magnetic force. When the developing roller 32 is rotated, the developer T in the developing chamber 23 is moved toward the photosensitive drum 62 by the developing roller 32. Further, the developing chamber 23 of the accommodating container 21 is provided with the opening where a developing blade 42 is mounted. The developing blade 42 is contacted to the developing roller 32 and regulates a thickness of a layer of the developer T formed at the surface of the developing roller 32.

Next, the cleaning unit 60 includes therein the photosensitive drum 62, the charging roller 66 and a residual toner chamber 71*b*. The residual toner chamber 71*b* is provided with a cleaning blade 77. A residual toner on the surface of the photosensitive drum 62 is removed by the cleaning blade 77 and then is used again in the image forming process. The toner removed from the photosensitive drum 62 is stored in the residual toner chamber 71*b*.

Figure 3:
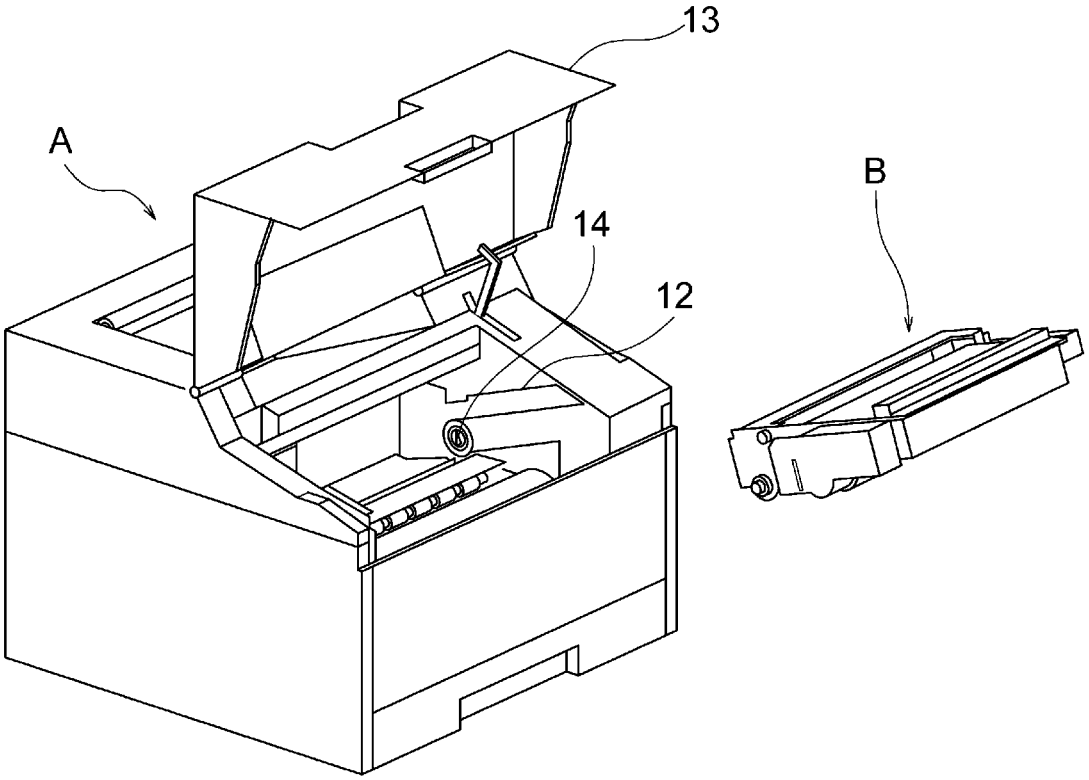
FIG. 3 is a perspective view of an apparatus main assembly and the cartridge.

FIG. 3 is a perspective view of the apparatus main assembly A and the cartridge B. As shown in FIG. 3, the apparatus main assembly A is provided with a door 13 rotatably. On a side wall in the inside of the apparatus main assembly A, a guide rail 12 is formed, and in a rear end side of the guide rail 12, a driving shaft 14 is provided. In the case where the cartridge B is mounted in the apparatus main assembly A, a shaft of the photosensitive drum 62 of the cartridge B is guided toward a rear side along the guide rail 12 and then is engaged with the driving shaft 14.

Although described later, the driving shaft to be driven by an unshown motor of the apparatus main assembly A engages with a driving force receiving portion 63*a* (FIG. 4) provided to the cartridge B. Then, to the driving force receiving portion 63*a*, the photosensitive drum 62 is connected, and thus the photosensitive drum 62 is rotated by receiving a driving force from the apparatus main assembly A. Incidentally, the charging roller 66 and the developing roller 32 are supplied with electric power from an electric power supplying portion (not shown) of the apparatus main assembly A.

Figure 4:
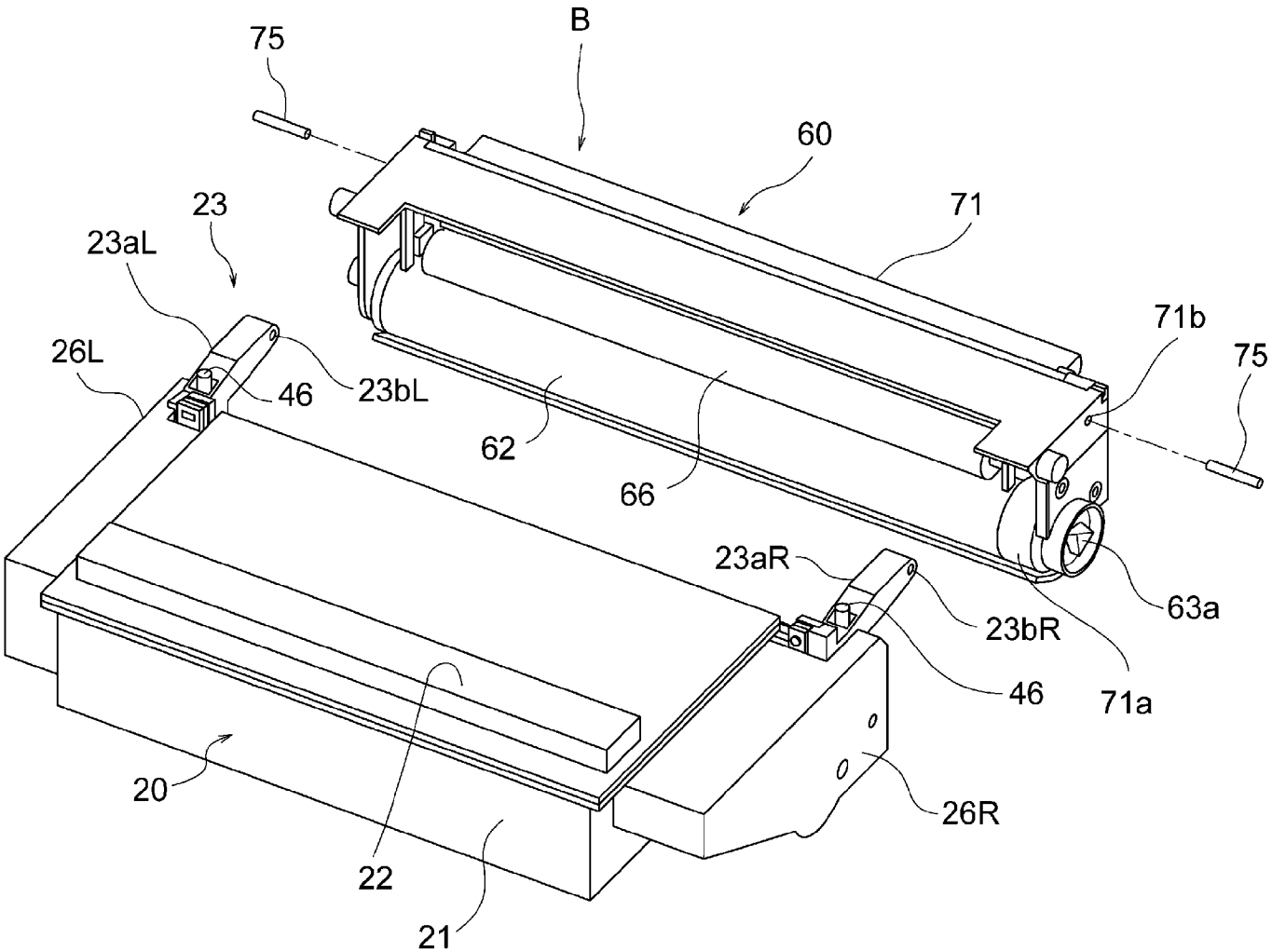
FIG. 4 is an exploded perspective views of the cartridge.
Figure 5:
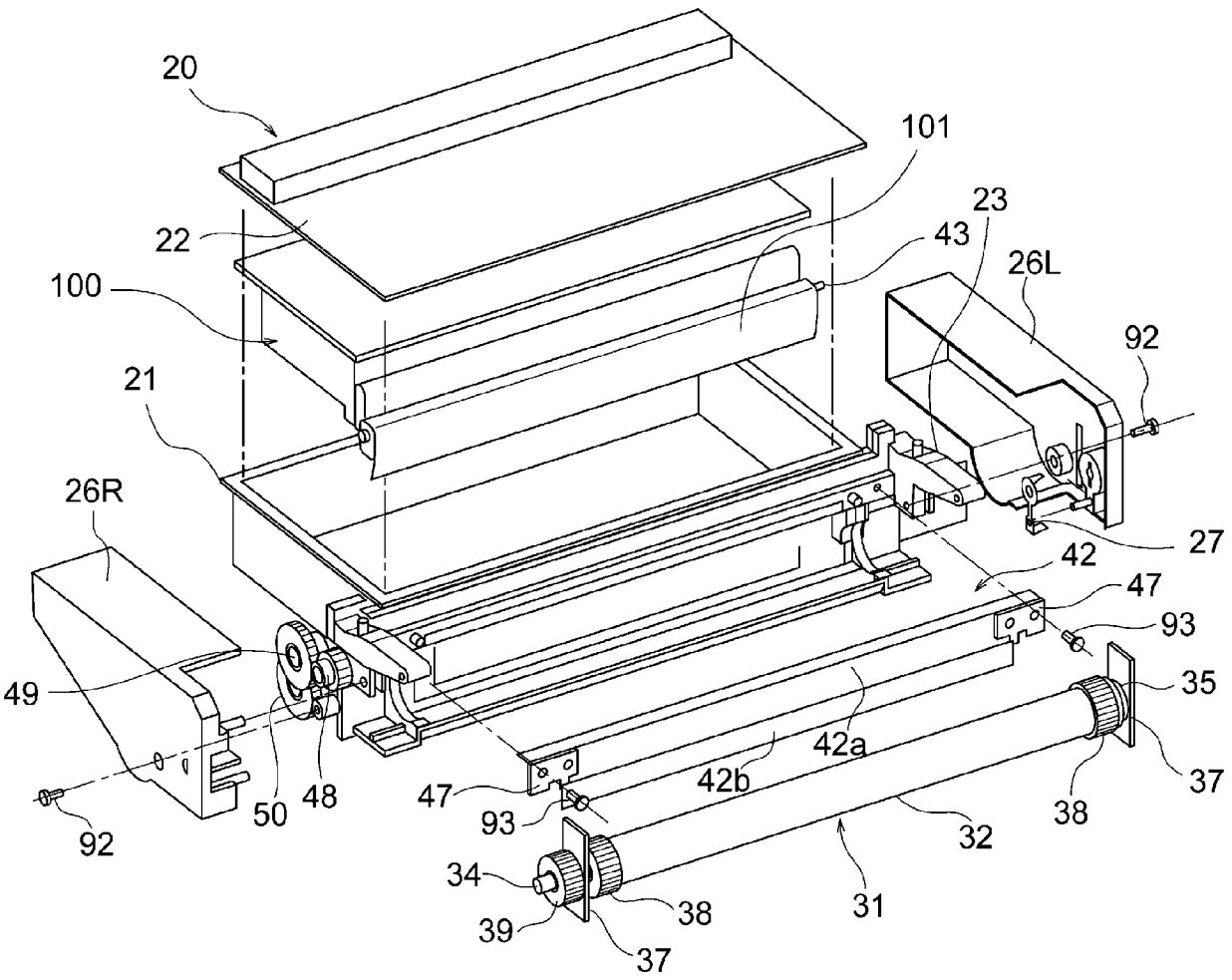
FIG. 5 is an exploded perspective view of a developing unit.

FIG. 4 is an exploded perspective view of the cartridge B. As shown in FIG. 4, the cartridge B is constituted by combining the developing unit 20 and the cleaning unit 60. The developing unit 20 includes the accommodating container 21, the cover 22, a first side member 26L, a second side member 26R and a spring 46. In a region surrounded by these members, the developing blade 42, the developing roller 32, the magnet roller 34, the actable member 43 and the developer bag 100 which are described with reference to FIG. 5 are disposed. The cleaning unit 60 includes a frame 71, the photosensitive drum 62, the charging roller 66 and the cleaning blade 77 (FIG. 2). The cleaning unit 60 and the developing unit 20 are rotationally movably connected with each other by connecting members 75 to constitute the cartridge B.

The developing unit 20 includes arm portions 23*a*L and 23*a*R, constituting the accommodating container 21, at longitudinal end portions of the developing unit 20. At free end portions of the arm portions 23*a*L and 23*a*R, rotation holes 23*b*L and 23*b*R penetrating in a direction parallel to an axial direction of the developing roller 32 are formed. Further, at each of longitudinal end portions of the frame 71, an engaging hole 71*a* for being engaged with a pin-like connecting member 75 is formed. Then, when the rotation holes 23*b*L and 23*b*R and the engaging hole 71*b* are positionally aligned with each other and the connecting members 75 are inserted into the rotation holes 23*b*L and 23*b*R and the engaging holes 71*b*, the cleaning unit 60 and the developing unit 20 are connected rotatably about the connecting members 75.

At this time, springs 46 (urging member) mounted at base portions of the arm portions 23*a*L and 23*a*R contact the frame 71, so that the springs 46 urge the developing unit 20, about the connecting members 75 as a rotation center, toward the cleaning unit 60. As a result, the developing roller 32 is pressed toward the photosensitive drum 62 with reliability. Then, by gap (spacing) holding members 38 (FIG. 5) mounted at end portions of the developing roller 32, the developing roller 32 is held with a predetermined gap from the photosensitive drum 62.

FIG. 5 is an exploded perspective view of the developing unit 20. As shown in FIG. 5, the developing unit 20 includes the cover 22, the accommodating container 21, the first side member 26L and the second side member 26R. These members are integrally connected with each other by welding or the like. Inside these members, the developer bag 100 in which the developer is contained is disposed. The developer bag 100 is fixed to the cover 22 at an upper portion thereof. Further, the sealing member 101 is fixed to the developer bag 100 at one end thereof, and is fixed to the actable member 43 at the other end thereof.

The developing roller gear 39 of the developing roller 32 is supported by a first gear 48. The first gear 48 is engaged with a second gear 49. The second gear is engaged with a feeding gear 50. The feeding gear 50 supports the actable member. Accordingly, a driving force transmitted from the apparatus main assembly A is, as shown in FIG. 4, transmitted to a driving force receiving portion 63*a*, so that the photosensitive drum 62 is rotated and thus a gear 71*a* of the photosensitive drum 62 is rotated.

Further, the gear 71*a* of the photosensitive drum 62 is engaged with the developing roller gear 39 of the developing roller 32 shown in FIG. 5. When the photosensitive drum 62 is rotated, the developing roller 32 is rotated. When the developing roller gear of the developing roller 32 is rotated, the first gear 48, the second gear 49 and the feeding gear 50 are rotated. In this way, the actable member 43 is rotated.

Incidentally, the actable member 43 is supported by the accommodating container 21 in the non-driving side, and is supported by the feeding gear 50 mounted to the accommodating container 21 in the driving side.

The developing blade 42 is constituted by a supporting member 42*a* formed with a metal plate and an elastic member 42*b* formed of an urethane rubber. Further, to this developing blade 42, a cleaning member 47 is fixed with screws 93. Specifically, the elastic member 42*b* and a cleaning member 47 are fixed together with the screws 93 at end portions of the supporting members 42*a*, thus being fixed to the accommodating container 21. The elastic member 42*b* contacts the surface of the developing roller 32, and imparts charges by triboelectrically charges the surface of the developing roller 32 to the developer T while regulating a developer actable at the surface of the developing roller 32. The cleaning member 47 contacts the axial end portions of the developing roller 32, so that the deposited matter such as the developer T is removed.

A developing roller unit 31 includes the developing roller 32, the magnet roller 34, the flange 35, the gap holding member 38, a bearing member 37, a developing roller gear 39 and the like. From an end portion of the developing roller 32 in the non-driving side, the magnet roller 34 is inserted, and then, the flange 35 is press-fitted and fixed. In the flange 35, an unshown electroconductive electrode wire is incorporated, and the electrode wire contacts the developing roller 32 and an electrode plate 27. The electrode plate 27 having electroconductivity is fixed on the first side member 26L. The electrode plate 27 contacts and supplies electric power to an unshown electric power supplying portion in the apparatus main assembly A, so that a bias voltage is applied, to the developing roller 32, from the electric power supplying portion of the apparatus main assembly A through the electrode plate 27 and an electrode wire as an electric power supplying path.

The gap holding member 38 is mounted at each of the longitudinal end portions of the developing roller 32. Outside the gap holding member 38, the bearing member 37 is disposed, and in the driving side, the developing roller gear 39 is incorporated outside the bearing member 37. The developing roller 32 is rotatably supported by the bearing member 37 disposed at each of the end portions of the developing roller 32.

The first and second gears 48 and 49 as a drive transmission member are rotatably mounted to the accommodating container 21.

The driving force obtained from the apparatus main assembly A is transmitted to the developing roller 32 via the photosensitive drum 62, the gear 71*b* (FIG. 4) and the developing roller gear 39, and is also transmitted to the actable member 43 via the first and second gears 48 and 49 and the feeding gear 50.

The first and second side members 26L and 26R are fixed with screws 92 to the accommodating container 21 at the longitudinal end portions. At that time, the bearing members 37 of the developing roller unit 31 are held by the first and second side members 26L and 26R.

Figure 6:
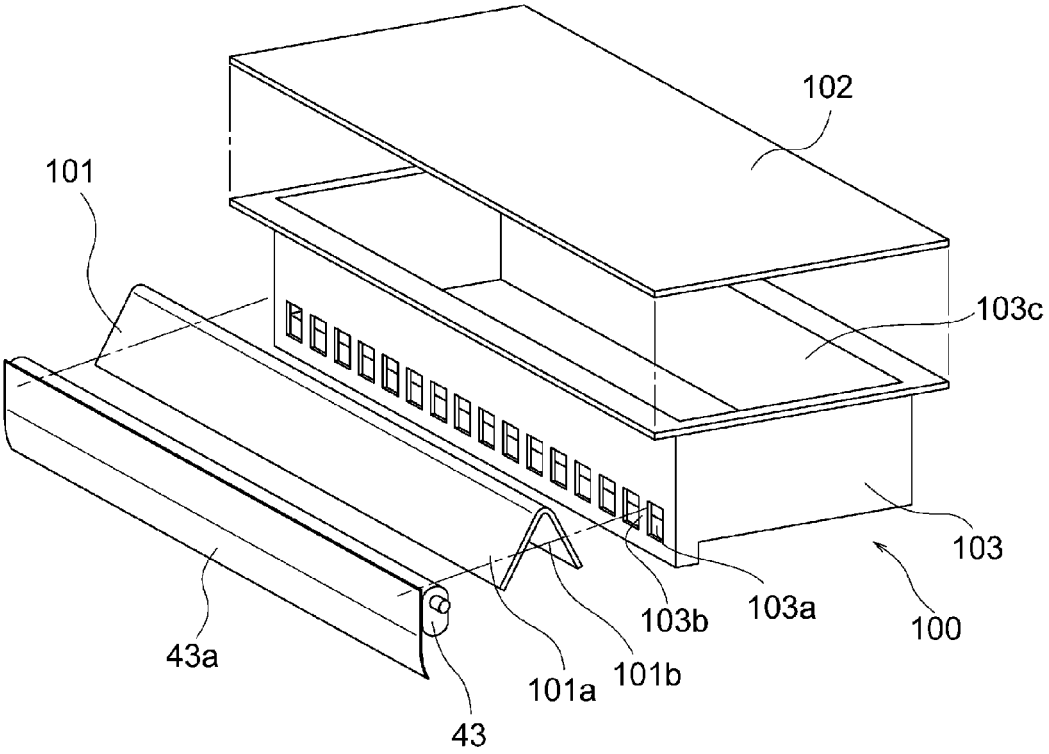
FIG. 6 is an exploded perspective view of a developer bag.

FIG. 6 is an exploded perspective view of the developer bag 100. As shown in FIG. 6, the developer bag 100 includes the accommodating member 103, the seal member 102 and the sealing member 101.

The accommodating member 103 as a flexible container is disposed inside the accommodating container 21 and is provided at a side thereof with discharge holes 103*a* as an opening for permitting discharge of the accommodated developer T. Further, the accommodating member 103 contains the developer T and has flexibility.

The accommodating member 103 is formed with a flexible sheet material formed by vacuum molding, air-pressure molding, press molding or the like. The discharge holes 103*a* are partitioned by a plurality of connecting portions 103*b* provided along the longitudinal direction of the accommodating member 103. Incidentally, herein, the flexible container refers to the accommodating member 103, but may also refer to the developer bag 100 including the seal member 102.

Figure 7:
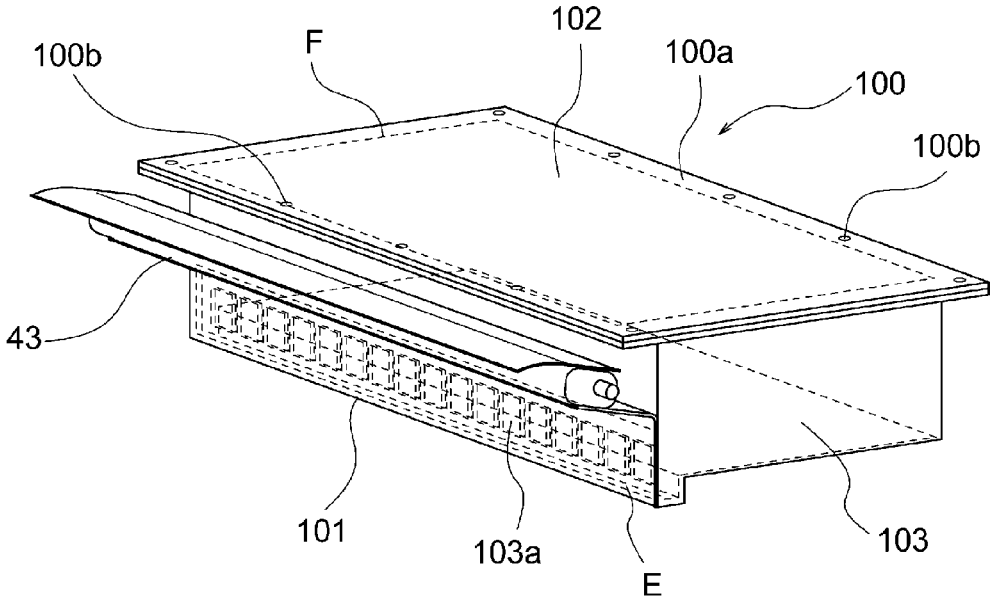
FIG. 7 is an assembling perspective view of the developer bag.

The sealing member 101 is provided with a sealing portion 101*b* for covering the discharge holes 103*a* of the accommodating member 103 and is provided with a fixing portion 101*a* to be fixed to the actable member 43 as an unsealing means. The sealing portion 101*b* of the sealing member 101 seals the discharge holes 103*a* before use, and unseals the discharging holes 103*a* when being used. FIG. 7 is an assembling perspective view of the developer bag 100. As shown in FIG. 7, the sealing portion 101*b* of the sealing member 101 is (thermally) welded so as to cover a whole of the discharge holes 103*a* of the accommodating member 103, thus sealing the discharge holes 103*a* (region E in the figure).

Figure 8:
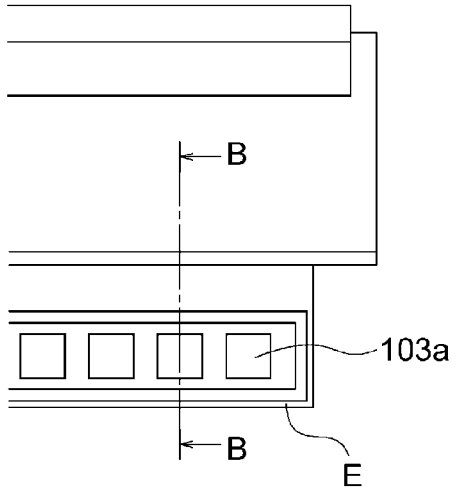
FIGS. 8, (*a*) and (*b*) are a sectional view and a perspective view, respectively, for illustrating a welding position of a sealing member to an accommodating member.
Figure 8:
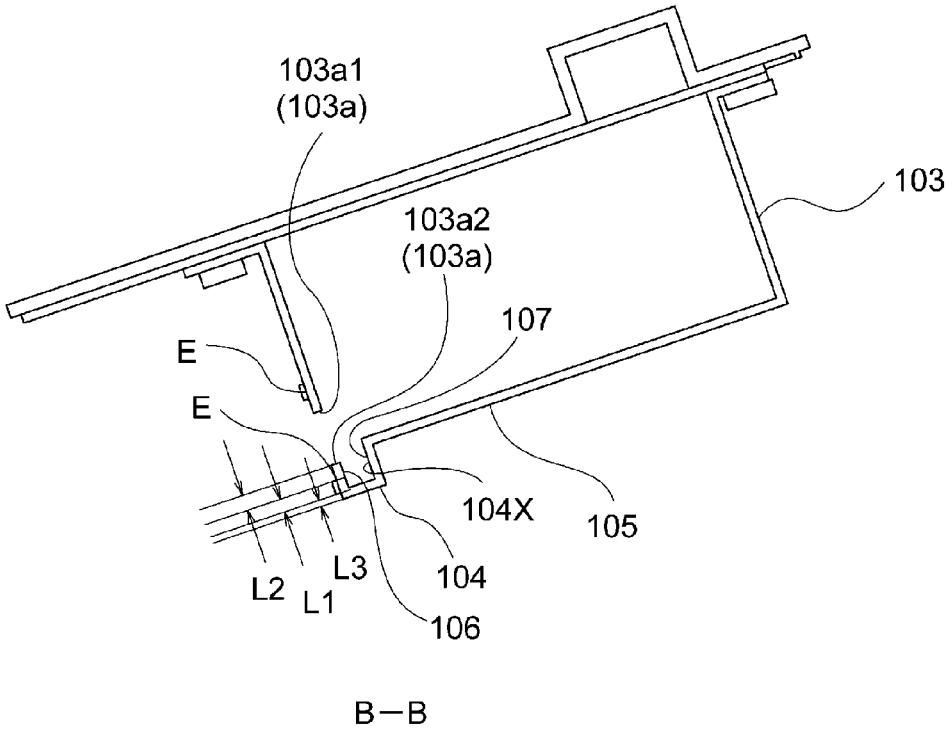

In FIGS. 8, (*a*) and (*b*) are a sectional view and a perspective view, respectively, for illustrating a welding position of the sealing member 101 relative to the accommodating member 103. As shown in FIG. 8, the discharge holes 103*a* of the accommodating member 103 has an upper end portion 103*a*1 and a lower end portion 103*a*2. At the lower end portion 103*a*2 of the accommodating member 103, a projection 104 is formed. The projection is projected vertically downward along the surface of the discharge holes 103*a*. The projection 104 is set to have dimensions including a welding dimension L1 in which the sealing member 101 is welded, and upper and lower marginal dimensions L2 and L3. In this embodiment, as a material for the sealing member 101, a laminate material having a special sealant layer which exhibits an easy peeling property (easy-to-peel property such that peeling strength is about 3N/15 mm in testing methods for heat sealed flexible package according to JIS-Z0238) is used. Further, as a material for the accommodating member 103, a flexible material which is weldable with the special sealant layer is used, so that it is possible to provide the easy peeling property at the thermal welding portion.

For the state of FIG. 6, the discharge holes 103*a* of the accommodating member 103 are sealed by the sealing portion 101*b* of the sealing member 101, and thereafter the developer T is filled in the accommodating member 103 through openings 103*c*. When the developer T is filled, a known auger-type filling device is used, but a filling method (means) having a similar function may also be used.

In a state in which the accommodating member 103 and the sealing member 101 are bonded to each other, the developer T is filled, and then the seal member 102 is (thermally) welded at a periphery of the openings 103*c* so as to seal the openings 103*c* (region F in FIG. 7). The seal member 102 is a flexible sheet member, and is provided with minute holes through which air is permeable. As shown in FIG. 7, when the developer bag 100 in which the developer T is filled is prepared, the flange portion 100*a* provided at the periphery of the developer bag 100 is provided with a plurality of fixing holes 100*b*.

On the other hand, the fixing portion 101*a* of the sealing member 101 is fixed to the actable member 43. The actable member 43 periodically acts on the accommodating member 103. When the actable member 43 acts on the accommodating member 103, the accommodating member 103 is swung, so that the accommodated developer T is discharged through the discharge hole 103*a*. Further, when the actable member 43 is caused to act on the accommodating member 103 so as to contact the projection 104, the actable member 43 compresses the projection 104 by the contact thereof with the projection 104, so that the developer T stored in a recessed portion of the projection 104 can be discharged. Incidentally, as a fixing means thereof, it is possible to use a means, other than the thermal welding, the ultrasonic welding, pseudo bonding, such as hooking using a hole and a projection.

Figure 9:
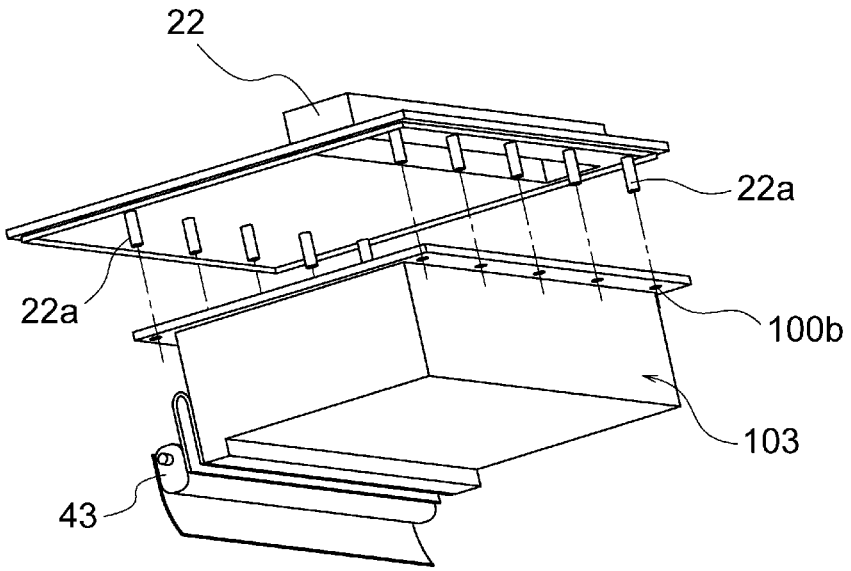
In FIGS. 9, (*a*) and (*b*) are an exploded perspective view and a perspective view, respectively, of the developer bag and a cover thereof.
Figure 9:
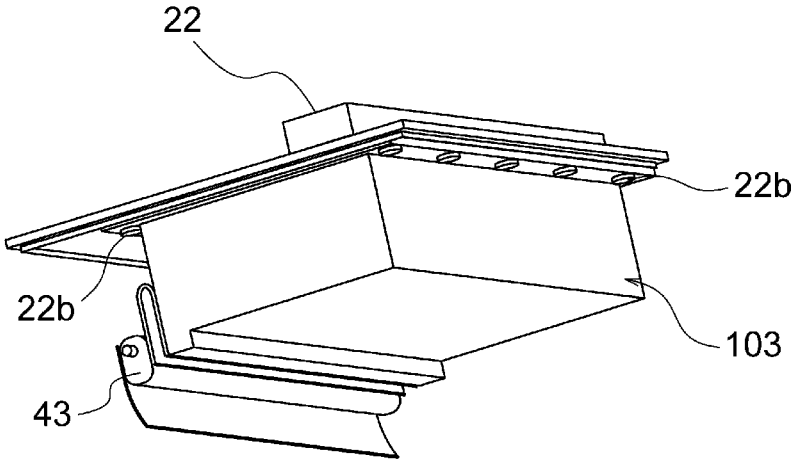

In FIG. 9, (*a*) is an exploded perspective view of the developer bag 100 and the cover 22. As shown in FIG. 9, in the case where the developer bag 100 is fixed to the cover 22, a plurality of fixing bosses 22*a* are passed through the fixing holes 100*b*.

In FIG. 9, (*b*) is a perspective view showing a connected state of the developer bag 100 with the cover 22.

As shown in (*b*) of FIG. 9, free ends of the fixing bosses 22*a* are deformed by being heated and melted. As a result, by free end portions 22*b* each deformed and extended, the developer bag 100 is fixed to the cover 22.

The fixing method between the cover 22 and the developer bag 100 is not limited to the above-described method in this embodiment but may also be a method, such as the (thermal) welding, the bonding, the hooking using the hole and the projection. In this way, after the upper end of the developer bag 100 is fixed to the cover 22, as shown in FIG. 6, in the accommodating container 21, the developer bag 100 is accommodated.

Figure 10:
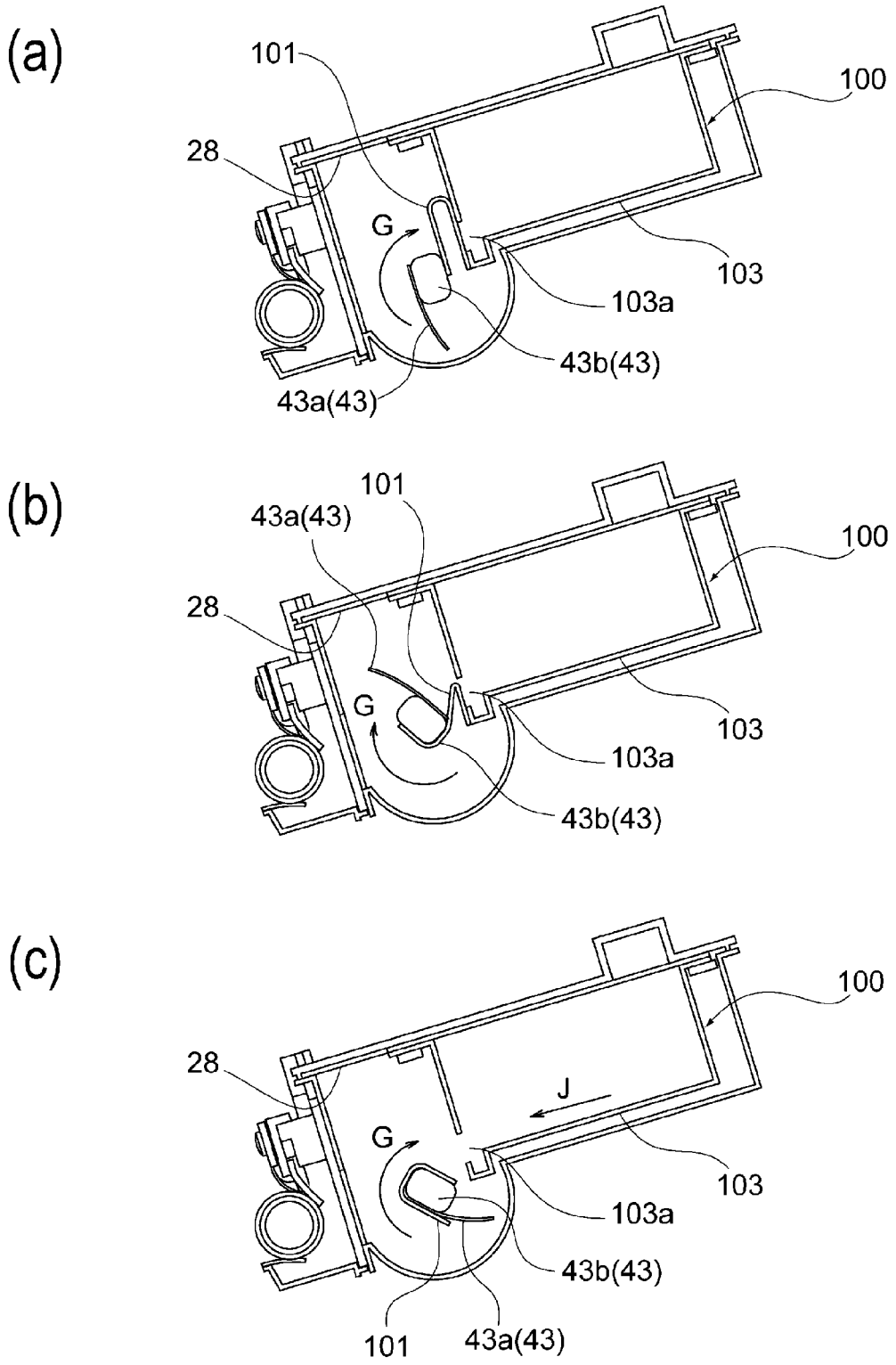
In FIG. 10, (*a*) to (*c*) are sectional views showing an unsealing process of the developer bag in a developing unit.

In FIG. 10, (*a*) to (*c*) are sectional views for illustrating an unsealing process of the developer bag 100 in the developing unit 20.

In FIGS. 10, (*a*), (*b*) and (*c*) are sectional illustrations showing states of the developer bag 100 before, during and after the unsealing, respectively. As shown in FIG. 10, the developer bag 100 and the actable member 43 are accommodated in the supplying chamber 28. When the cartridge B is mounted in the apparatus main assembly A, the driving force is transmitted from the apparatus main assembly A, and then the actable member 43 is rotated in an arrow G direction, so that the state thereof is changed from the state of (*a*) of FIG. 10 to the state of (*b*) of FIG. 10.

At this time, the sealing member 101 is wound up around the actable member 43, and at the same time, the welded portion between the sealing portion 101*b* and the accommodating member 103 is peeled, so that the discharge holes 103*a* of the accommodating member 103 are started to be exposed. Further, the sealing member 101 is completely wound up around the actable member 43 so as to change in state from the state of (*b*) of FIG. 11 to the state of (*c*) of FIG. 11, so that the discharge holes 103*a* are completely exposed.

Figure 11:
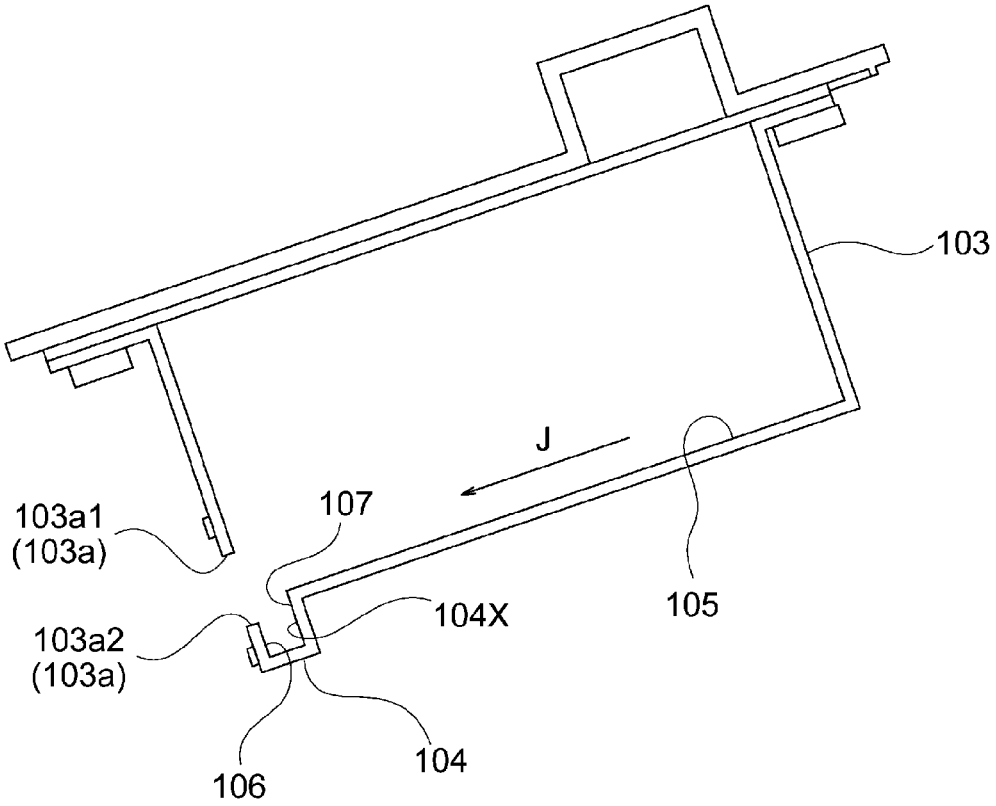
FIG. 11 is a sectional view of the developer bag.

FIG. 11 is a sectional view of the developer bag 100. As shown in FIG. 11, the accommodating member 103 is stretched along the side where the discharge holes 103*a* to be formed, and then the projection 104 projected vertically downward is formed. When the discharge holes 103*a* are formed in the accommodating member 103 after the accommodating member 103 is formed by vacuum molding, a member is inserted at the projection 104 to form a receiving portion where the discharge holes 103*a* are formed from an outside of the projection 104. Further, in order that the lower end (portion) 103*a*2 is located at a position lower than a bottom 105, there is a need to provide the projection 104.

Further, a bottom portion 105 excluding the projection 104 of the accommodating member 103 is provided vertically over the projection 104. The bottom portion 105 forming the bottom of the accommodating member 103 is disposed vertically over the lower end 103*a*2 of the discharge holes 103*a*. Further, the bottom portion 105 is formed in a planar shape so that the developer is easily moved along a surface thereof and thus is not stagnated. Further, the bottom portion 105 is set so as to be inclined with respect to the horizontal direction.

Incidentally, in this embodiment, the bottom portion 105 is formed in the planar shape but is not necessarily required to be formed in the planar shape, and a stepwisely inclined constitution may also be employed. For this reason, in the case where in the accommodating member 103, a height of the bottom portion 105 in a side (rear side) remote from the discharge holes 103*a* is a first height and a height of the bottom portion 105 in a side (front side) close to the discharge holes 103*a* is a second height, these heights are set so that the first height is higher than the second height.

The projection 104 is provided with a recessed portion 104X in an inside thereof where the inside is projected in a U-shape, the recessed portion 104X has a first side portion 106 and a second side portion 107. The first side portion 106 is formed at an inner surface of the recessed portion 104X in a side close to the discharge holes 103*a*. The second side portion 107 is formed at the inner surface of the recessed portion 104X in a side opposite from the side close to the discharge holes 103*a*.

Further, as shown in (*c*) of FIG. 10, when the discharge holes 103*a* are completely exposed, a part of the developer T is discharged through the discharge holes 103*a* by a force directed in an arrow J direction based on a component force of gravitation. With contact and spacing between the developer bag 100 and the sheet member 43*a*, the developer bag 100 is vibrated. As a result, the developer T deposited on the inner wall of the developer bag 100 drops on the bottom portion 105. At the same time, by the vibration of the developer bag 100, the developer T in the developer bag 100 is satisfactorily loosened.

As shown in FIG. 11, the developer T on the bottom portion 105 is moved toward the discharge holes 103*a* along the surface of the bottom portion 105 and enters the recessed portion 104X of the projection 104, and the developer which does not enter the recessed portion 104X is discharged through the discharge holes 103*a*. As shown in FIG. 11, in the constitution in Embodiment 1 (this embodiment), the developer T except the developer entered the recessed portion 104X can be efficiently discharged, and therefore an amount of the developer T remaining in the developer bag 100 is reduced.

Figure 12:
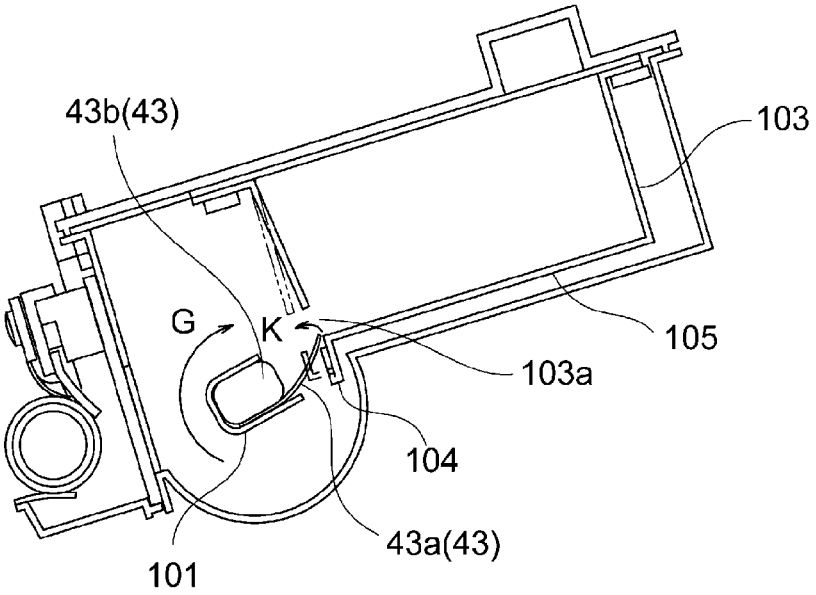
FIG. 12 is a sectional view showing a state in which a sheet member acts on a projection.

FIG. 12 is a sectional view showing a state in which the sheet member 43*a* acts on the projection 104. As shown in FIG. 12, the sheet member 43*a* periodically contacts the projection 104, and thus the state is changed from a state indicated by a broken line in the figure to a state indicated by a solid line in the figure. Thus, a positional relationship such that the sheet member 43*a* efficiently deforms the developer bag is set. As a result, the developer T in the recessed portion 104X is pushed out in an arrow K direction through the discharge holes 103*a*, so that the amount of the developer T remaining inside the developer bag 100 is further reduced.

Embodiment 2

Figure 13:
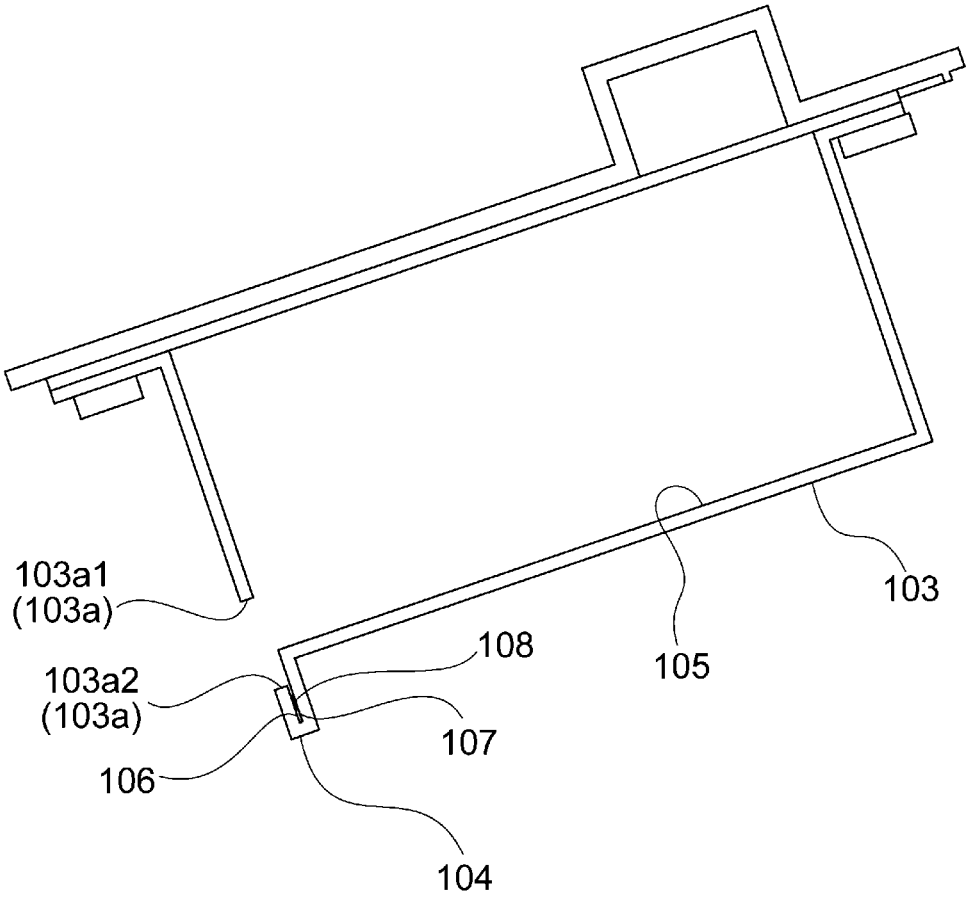
FIG. 13 is a sectional view of a developer bag in Embodiment 2.

FIG. 13 is a sectional view of a developer bag 100 in this embodiment. In this embodiment, constituent elements identical to those in Embodiment 1 are represented by the same reference numerals and will be omitted from description. As shown in FIG. 13, the accommodating member 103 is provided with a projection 104. The projection 104 has a first side portion 106 in the side close to the discharge holes 103*a* and a second side portion 107 in the side, opposite to the side close to the discharge holes 103*a*, close to the bottom portion 105. The first and second side portions 106 and 107 are may only be required to be at least partly bonded to each other. However, in this embodiment, the first and second side portions 106 and 107 are fixed partly at a (thermal) welding portion 108 over a whole area with respect to a longitudinal direction. Further, in this embodiment, the first and second side portions 106 and 107 are partly bonded to each other with respect to a vertical direction.

By employing such a constitution, a volume of the projection 104 is reduced, so that the amount of the developer entered a recessed portion of the projection 104 is reduced. In this embodiment, a fixing method between the first and second side portions 106 and 107 is not limited to the above-described method, but may also be adhesive bonding, a double-side tape, clamping with a member, and the like. The welding region may also be formed in a spot area or a whole area. As described above, also in the constitution in this embodiment, the amount of the developer remaining inside the developer bag 100 is decreased.

Incidentally, a constitution in which the first and second side portions 106 and 107 are bonded to each other over the entire longitudinal region is employed, but the present invention is not limited thereto. That is, the first and second side portions 106 and 107 may also be bonded to each other partly with respect to the longitudinal direction.

According to the constitution in Embodiment 1 or 2, it is possible to efficiently discharge the developer T accommodated in the flexible container without providing the leaf spring in the accommodating member 103.

Figure 14:
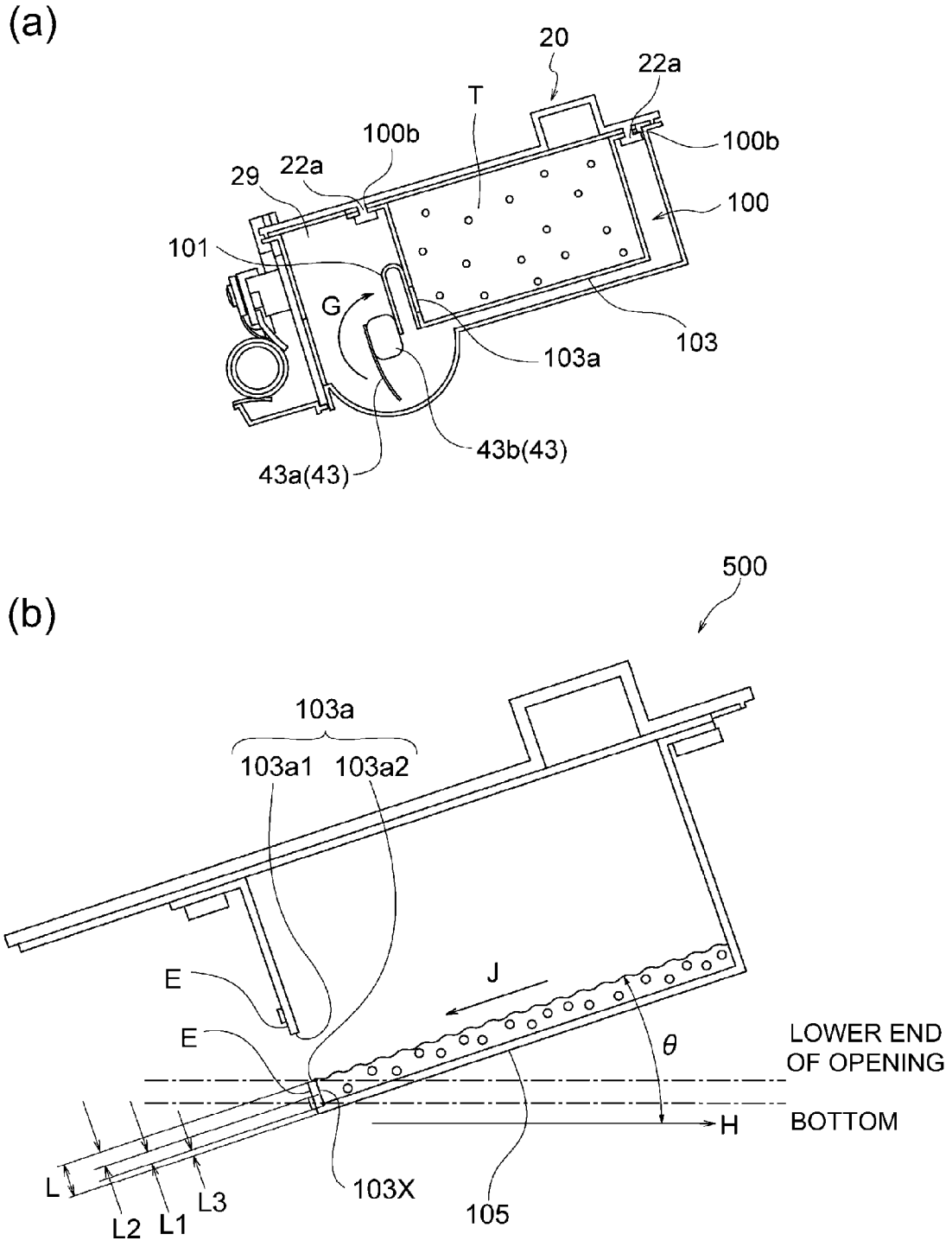
In FIGS. 14, (*a*) and (*b*) are sectional views of a developer bag in Comparison Example.
Figure 15:
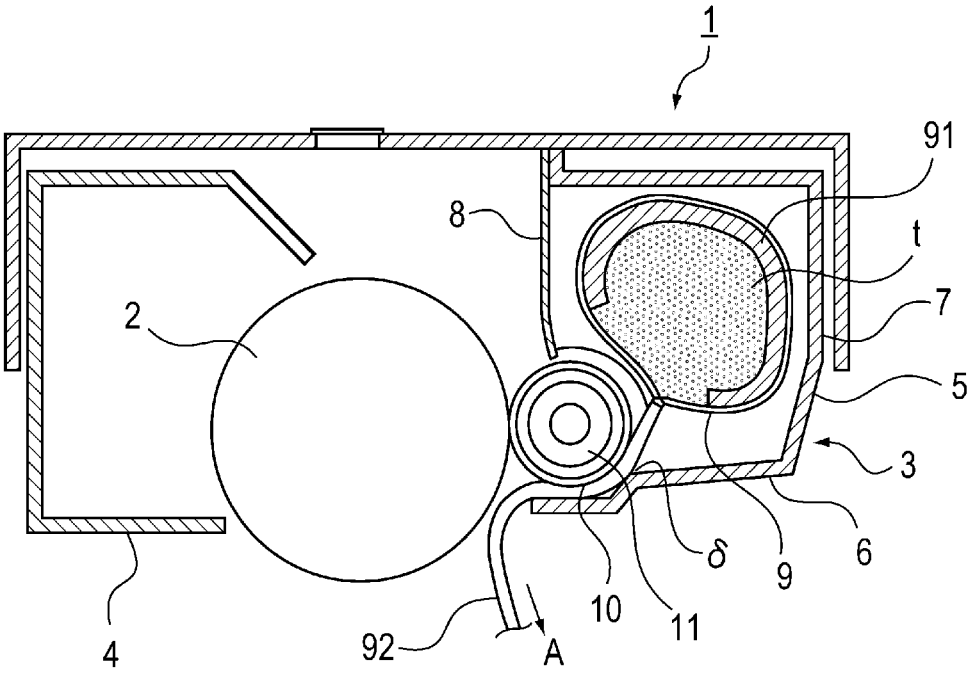
FIG. 15 is a sectional view of a cartridge in JP-A Hei 4-66980.

In FIGS. 14, (*a*) and (*b*) are sectional views of a developer bag 500 according to Comparison Example. In the developer bag 500 shown in FIG. 14, the discharge holes 103*a* of the accommodating member 103 have the upper end (portion) 103*a*1 and the lower end (portion) 103*a*2. The developer T in the developer bag 500 is moved toward the discharge holes 103*a* along the surface of the bottom portion 105. However, a part of the developer T is blocked by a wall 103X formed so as to extend from the bottom portion 105 to the lower end 103*a*2. This wall 103X is required to have a width (height) L which is the sum of a width L1 of a welding portion E and widths L2 and L3 of upper and lower marginal portions. In this way, a part of the bottom portion 105 is positioned vertically below the lower end 103*a*2 of the discharge holes 103*a*, the developer T remains in the developer bag 500 with a power (developer) surface extended from the lower end 103*a*2 with a predetermined angle θ with respect to the horizontal direction H.

According to the present invention, without providing the leaf spring in the flexible container, the developer accommodated in the flexible container can be efficiently discharged.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 131849/2013 filed Jun. 24, 2013, which is hereby incorporated by reference.

What is claimed is:

1. A cartridge detachably mountable to a main assembly of an image forming apparatus, said cartridge comprising:

a frame;

a flexible container, provided with an opening at a side thereof and provided inside said frame, for accommodating developer; and a sealing member for sealing the opening, wherein said flexible container includes a bottom point of a bottom portion being nearest to the opening, wherein said bottom point is provided vertically above a lower end of the opening in a state in which said cartridge is mounted in the main assembly, and wherein a relative position of the opening with said frame is changed during operation.

2. A cartridge according to claim 1, wherein said sealing member includes a fixing portion for sealing the opening by surrounding the opening, and wherein said flexible container is provided with a projection, in a side where the opening is provided, projected vertically downward.

3. A cartridge according to claim 2, further comprising an actable member actable on said flexible container.

4. A cartridge according to claim 3, wherein said actable member periodically contacts said projection.

5. A cartridge according to claim 2, wherein said projection includes therein a recessed portion where an inside of said flexible container is projected in a U shape, and wherein said projection includes a first side portion formed at an inner side of said recessed portion in a side close to the opening and includes a second side portion formed at the inner side of said recessed portion in a side opposite from the side close to the opening.

6. A cartridge according to claim 5, wherein said first and second side portions are bonded at least partly to each other.

7. A cartridge according to claim 6, wherein said first and second side portions are partly bonded to each other with respect to a longitudinal direction.

8. A cartridge according to claim 6, wherein said first and second side portions are partly bonded to each other with respect to a vertical direction.

9. A cartridge according to claim 2, wherein said flexible container is formed by vacuum molding.

10. A process cartridge comprising:

a cartridge according to claim 1 including an image bearing member.

11. A developing cartridge comprising:

a cartridge according to claim 1 including a developer carrying member.

12. An image forming apparatus comprising:

a main assembly; and a cartridge according to claim 1.

13. A cartridge according to claim 1, wherein the flexible container includes a plurality of openings.

14. A cartridge detachably mountable to a main assembly of an image forming apparatus, said cartridge comprising:

a frame;

a flexible container, provided with an opening at a side thereof and a projection, for accommodating developer; and an actable member actable on said projection of said flexible container to deform said projection, wherein said flexible container includes a bottom portion, and wherein said bottom portion is provided vertically above a lower end of the opening in a state in which said cartridge is mounted in the main assembly.

15. A cartridge according to claim 14, wherein said flexible container includes a plurality of openings.

16. A cartridge according to claim 14, further comprising a sealing member for sealing the opening, wherein said sealing member is removable when being used.

* * * * *